US005147462A

United States Patent [19]

Wollam

[11] Patent Number: 5,147,462

[45] Date of Patent: Sep. 15, 1992

[54] APPARATUS FOR AUTOMATIC FILM THICKNESS CONTROL

[75] Inventor: Carl A. Wollam, Cortland, Ohio

[73] Assignee: Alcan Aluminum Corporation, Cleveland, Ohio

[21] Appl. No.: 481,603

[22] Filed: Feb. 16, 1990

[51] Int. Cl.[5] ..... B05C 5/02

[52] U.S. Cl. ..... 118/679; 118/697; 118/712; 118/126; 118/407; 118/413

[58] Field of Search ..... 118/668, 672, 676, 685, 118/712, 126, 407, 409, 679, 680, 413, 415, 696, 697

[56] References Cited

U.S. PATENT DOCUMENTS

| | | | |
|---|---|---|---|
| 2,909,660 | 10/1959 | Alexander | 118/672 |
| 4,291,642 | 9/1981 | Kolc | 118/680 |
| 4,375,202 | 3/1983 | Miller | 118/126 |
| 4,675,230 | 6/1987 | Innes | 118/107 |
| 4,702,931 | 10/1987 | Falcoff | 118/712 |
| 4,732,776 | 3/1988 | Boissevain | 118/712 |
| 4,899,687 | 2/1990 | Sommer et al. | 118/126 |
| 4,899,691 | 2/1990 | Fitzgerald, Jr. et al. | 118/126 |

FOREIGN PATENT DOCUMENTS

| | | | |
|---|---|---|---|
| 60-34856 | 2/1985 | Japan | 118/712 |

*Primary Examiner*—W. Gary Jones
*Assistant Examiner*—Todd J. Burns
*Attorney, Agent, or Firm*—Cooper & Dunham

[57] ABSTRACT

Paint or the like coating is applied to a gap between an elongated strip article and an extended surface, such as a coating head. A variable load, such as provided by air cylinders, is continuously exerted on the extended surface during operation for urging the extended surface against the applied layer on the strip, so as to maintain a uniform metering gap between the extended surface and the coated strip surface. The extended surface has a sensor for repetitively determining metering gap. A computer monitors the sensor output and causes load-exerting air cylinders to vary their applied load, in order to urge the coating head toward or away from the back-up roll, so as to reduce difference between the sensed metering gap and a predetermined gap, thus producing a uniform coating film thickness on strip articles having non-uniform surface topography.

10 Claims, 6 Drawing Sheets

APPARATUS FOR AUTOMATIC FILM THICKNESS CONTROL

BACKGROUND OF THE INVENTION

This invention relates to the coating of major surfaces of elongated strip articles, such as sheet metal strip and the like. More particularly, it relates to apparatus and methods for continuously and automatically controlling the thickness of a layer of paint or other liquid coating material applied to a strip major surface.

By way of specific illustration, detailed reference will be made herein to the coating of sheet metal in greatly elongated strip form, as used for making siding panels cladding exterior building walls, it being understood, however, that the invention in its broader aspects embraces other coating of other types of articles and surfaces, as well as detection and maintenance of film thickness.

In the production of siding panels for metal strip, at least one major surface of the strip is first given a protective and decorative coating of paint, and the strip is thereafter formed and cut into individual panels. As described, for example in U.S. Pat. No. 4,675,230, the disclosure of which is fully incorporated herein by this reference, there is shown an apparatus and procedure for applying paint or the like coating material to an elongated strip article using a coating head having an open-sided slot to which coating material is supplied under pressure, and a support, such as a roll around which the strip is advanced past the head for receiving from the slot a layer of paint metered between the head and the strip, wherein a load is continuously exerted on the head during operation for urging the head against the applied paint layer on the strip, so as to maintain a uniform metering gap between the head and the coating surface. The load may be exerted by devices such as air cylinders acting on the head and capable of adjustment to vary the magnitude of the load for different coating operations.

In coating operations of the general type described in U.S. Pat. No. 4,675,230, desired coating thickness uniformity requires maintenance of a metering orifice of invariant aperture; i.e., the spacing between the coating head and the coated strip major surface downstream of the slot must remain constant despite variations in the thickness of the strip being coated. It is desirable to be able to translate the coating head relative to the major surface of the article being coated, so as to be able to maintain the desired constant orifice width, i.e., distance between the head surface and the major surface of the article being coated, so as to compensate for nonuniformities in the article major surface topography. For example, if the article which is being coated is a sheet of aluminum or other metal, the sheet may have local thickness variations longitudinally or laterally across the sheet, which will vary the topography of the sheet surface. Therefore, in order to maintain a uniform coating thickness across the sheet (i.e., constant orifice width), in spite of sheet surface topography variations, the coating head must be conformed to the sheet strip's surface topography.

SUMMARY OF THE INVENTION

The present invention, in a first aspect, broadly contemplates the provision of a new and improved strip coating apparatus having an automatic film thickness control system, which automatically conforms the coating head to changes in strip major surface topography.

The apparatus of the present invention comprises means for positioning an extended surface a predetermined distance away from the major surface, which major surface is extended in a direction of article advancement, so that the extended surface traverses the path of the advancing article and is translatable in a direction perpendicular to the article major surface, with the extended surface and the major surface forming a distance gap therebetween which is variable in response to extended surface translation. The apparatus also includes means for continuously longitudinally advancing the article successively past the extended surface and means for supplying liquid coating material to the gap in sufficient quantities to fill the gap substantially as the strip advances past the extended surface. The apparatus also has means for sensing repetitively distance between the extended surface and the article major surface and for generating a sensor signal indicative of such sensed distance; means for continuously urging the extended surface toward the article major surface by exerting on the extended surface a variable load and means for varying the load in response to the sensor signals, so as to reduce difference between the sensed distance and a predetermined distance, thus producing a layer of liquid coating material having a predetermined film thickness on the article.

In other embodiments, the apparatus of the present invention comprises means for continuously longitudinally advancing a strip article over a support for the strip article. The apparatus also has means for positioning an extended surface a predetermined distance away from the major surface of the strip article opposite the strip support, which major surface is extended in the direction of advancement of the strip article and traverses a path of the advancing article, while permitting translational movement of the extended surface perpendicular to the strip article major surface, forming a distance gap having a height between the major surface and the extended surface, which gap height varies in response to the translational movement. The apparatus also has means for supplying liquid coating material to the gap sufficient to fill the gap substantially as the strip article advances past the extended surface and means for continuously urging the extended surface toward the major surface by exerting on the extended surface a load having a variable magnitude. The apparatus of the present invention includes means for repetitively sensing the gap distance between the extended surface and the adjacent article major surface and for generating a sensor signal and means for controlling the urging means to vary the load magnitude on the extended surface in response to the sensor signal, so as to reduce difference between the gap height and a predetermined height, thus producing a layer of liquid coating material of a predetermined film thickness on the longitudinally advancing strip article.

One type of load exerting means contemplated is an air cylinder or the like. The sensing means may include an inductive electromagnetic transducer. A contemplated controlling means is a computer.

Advantageously, the load-exerting means utilized in the present invention is a plurality of air cylinders acting on the extended surface at spaced locations along its length and the sensing means is a plurality of sensors mounted on the extended surface in proximity to each air cylinder, with each sensor generating a separate sensor signal.

In preferred embodiments, the advancing means includes a roll having an axis parallel to the long dimension of the extended surface, the roll further having a cylinder surface position closely adjacent the extended surface. In some embodiments of the present invention, the apparatus has at least one valve coupled to each air cylinder and an air pressure source for regulating air cylinder pressure response to control signals generated by the computer control means, which is indicative of air pressure to be maintained in the cylinder.

Another aspect of the invention contemplates the provision of a method of controlling the thickness of a coating of a major surface of an advancing article, with a uniform predetermined thickness of a liquid coating material comprising positioning an extended surface a predetermined distance away from a major surface of the article, which major surface is extended in a direction of article advancement along an advancement path, so that the extended surface traverses the path and is translatable in a direction perpendicular to the article major surface, with the major surface and the extended surface forming a distance gap there between which is variable in response to extended surface translation. While positioning, the method includes continuously advancing a strip article successively past the extended surface, while supplying liquid coating material to the gap in sufficient quantities to fill substantially the gap as the article advances past the extended surface. While advancing and supplying, the method includes sensing repetitively distance between the extended surface and the article major surface, while continuously urging the extended surface toward the article major surface by exerting on the extended surface a load having a variable magnitude. While performing the above-recited simultaneous steps, the method includes varying the load in response to the sensing, so as to reduce difference between the sensed distance and a predetermined distance, thus producing a layer of liquid coating material having a predetermined film thickness on the advancing article.

In the apparatus and method of the present invention, the automatic maintenance of a variable load on the extended surface in response to sensing distance between the extended surface and the article major surface, and varying the load in response to the sensing, so as to reduce difference between the sensed difference and a predetermined difference, enables the extended surface to conform to variations in the strip major surface topography, thus maintaining a constant metering orifice aperture for controlling the coating layer thickness.

Further features and advantages of the invention will be apparent from the detailed description hereinbelow set forth, together with the accompanying drawings.

DETAILED DESCRIPTION

Figure 1:
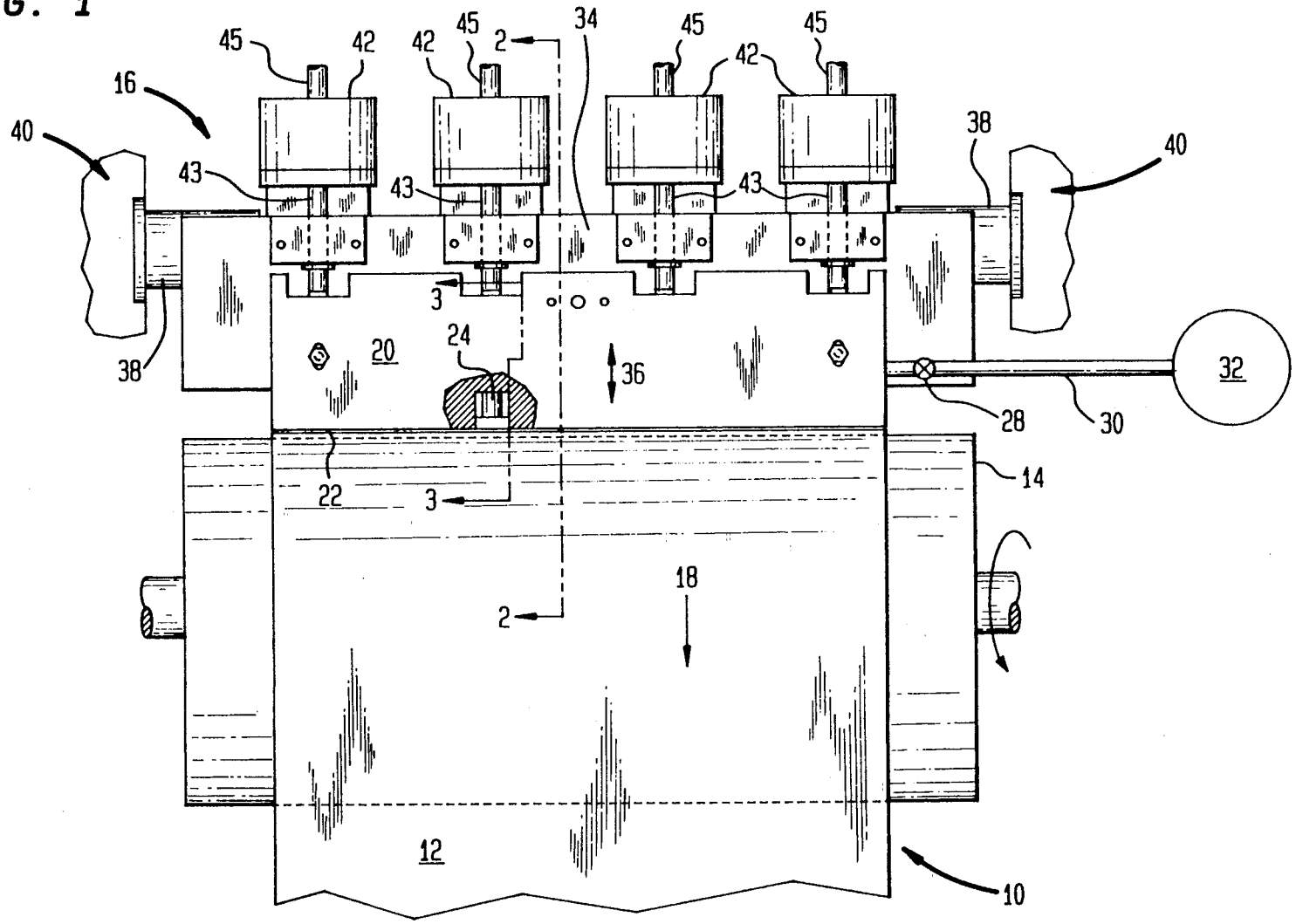
FIG. 1 is a simplified, partial fragmentary, schematic plan view of a coating apparatus embodying the present invention in a particular form.

The present invention pertains to apparatus and methods for regulating the film thickness of a coating applied to a surface. Coating material may be applied to the surface by any means known in the art, such as for example with a slot orifice coater, a roller or with a spray paint extruder.

The invention is illustrated in the drawings as embodied in procedures and apparatus in coating sheet metal strip to establish a uniform, single-color paint layer on a major surface of the strip before the strip is formed and cut to produce siding panels. Such strip is typically an elongated, flat sheet metal article (having a length corresponding to the combined length of a substantial number of panels and a width corresponding to the width of one or more panels), of a gauge suitable for siding panels, and is usually coiled for ease of handling.

Figure 2:
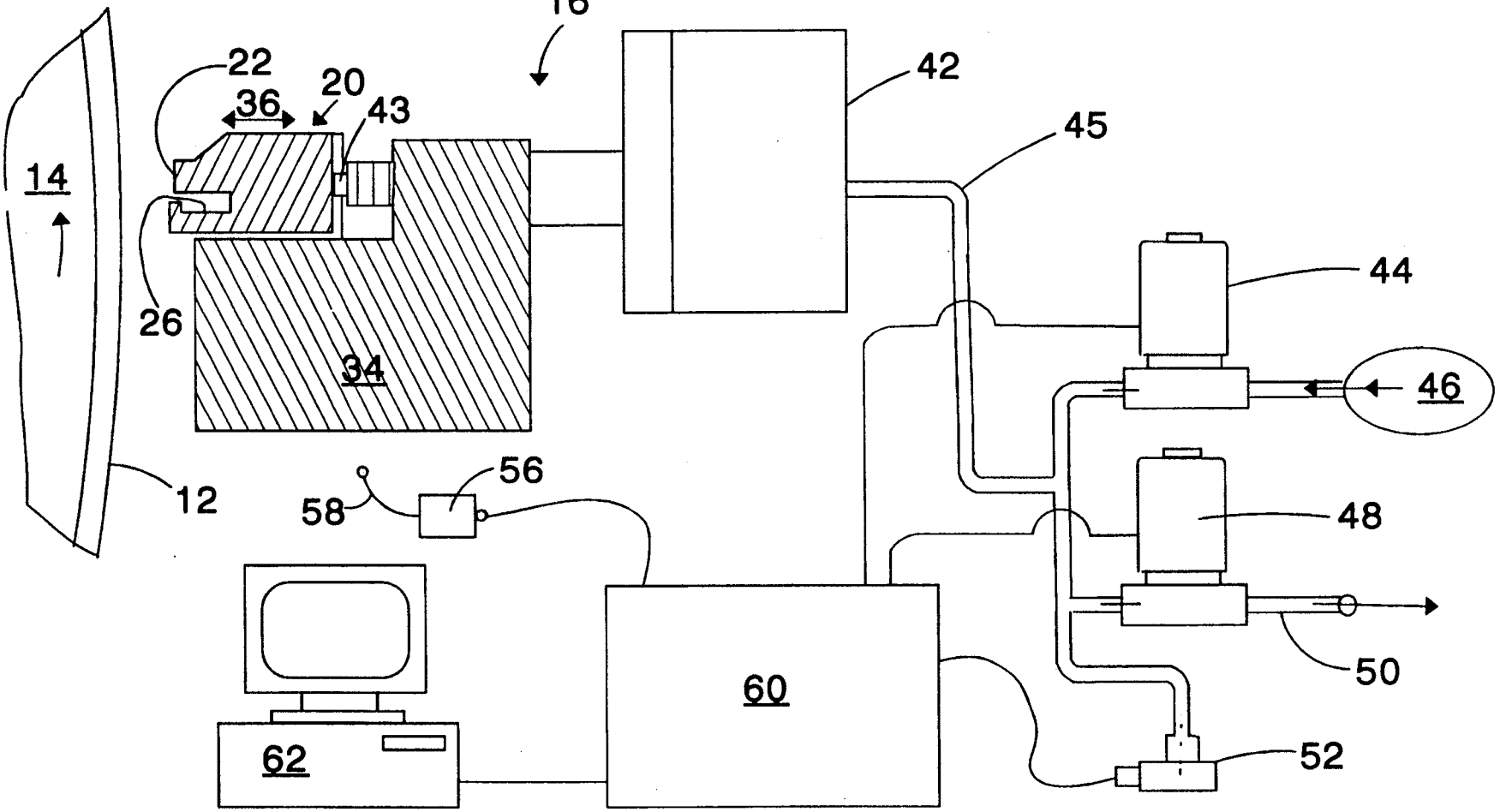
FIG. 2 is a schematic, partial cross-sectional view of the apparatus of FIG. 1, taken along 2—2 thereof.
Figure 3:
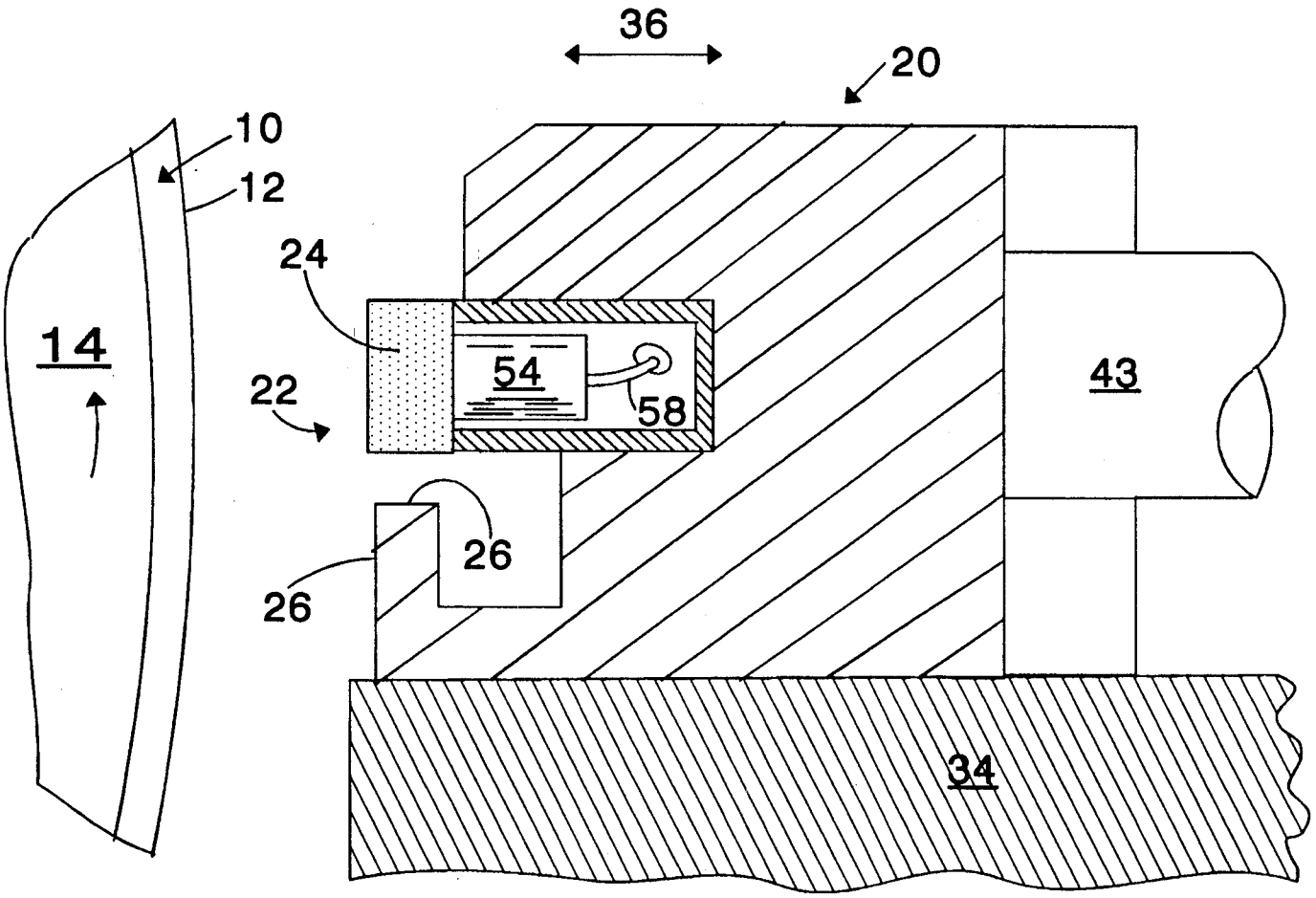
FIG. 3 is a schematic, partial cross-sectional view of the apparatus of FIG. 1, taken along 3—3 thereof.

U.S. Pat. No. 4,675,230 describes the general operation of a coating line and the mechanics how a slot orifice-type coating device transfers coating material to the metal strip. The automatic film thickness control apparatus of the present invention is schematically shown in FIGS. 1–3 in use in conjunction with a slot orifice-type coater, wherein a metal strip 10 which has a major surface 12 to be coated is continually advanced longitudinally parallel to its long dimension around a back-up roll 14 which is rotatively supported in an axially fixed position. At a locality at which the strip 10 is held against the back-up roll, paint or other coating material is applied to the outwardly facing major surface 12 from a coating device 16 in order to establish on the strip surface 12 a continuous layer or coating of the paint. The direction of strip advance is indicated by arrow 18.

The coating device 16 has a coating head 20. The most desirable location for the head is on the horizontal centerline of the back-up roll 14, though other locations may be used.

As shown in greater detail in FIGS. 2 and 3, the head 20 has and extended surface 22 which preferably is ground to match the radius of the back-up roll 14. The head, including the extended surface 22 is preferably constructed from machined steel bar stock fabrications. As shown in FIG. 3, the extended surface 22 also includes ceramic plates 24 which are bonded to the machined steel body and which have the same surface profile shape as the extended surface 22. The ceramic face 24 of the extended surface 22 is sloped slightly to create an inlet gap at the bottom face with respect to the upwardly moving strip 10 and a narrower outlet gap at the top of the face.

The head also has a head slot 26 which is constructed therein and which is a manifold for paint or other coating material that is to be applied to the metal strip 10. As shown in FIG. 1, the manifold has at least one coating supply valve 28, a coating supply line 30 and a pressurized coating source 32. Construction and operation of the coating supply system of the coating device 16 is explained in greater detail in U.S. Pat. No. 4,675,230. The coating material is applied to the strip major surface through head slot 26 and the film thickness is established by the gap between the strip major surface 12 and the head extended surface 22 (more particularly the ceramic face 24).

Head support deck 34 orients the head 20 relative to the back-up roll 14 and permits translation of the head, as shown by the arrow 36 in FIGS. 1–3. The head support 34 has a head support shaft 38 for pivotal movement about a fixed frame 40 (shown as a fragmentary view) so as to enable the head 20 with the head support deck 34 to be swung upwardly (e.g., by suitable pneumatic means, not shown) from the position illustrated in FIGS. 1–3 to remove the head 20 from the path of strip advance. The pivotal movement of the head 20 relative to the frame 40 allows the head to be moved away from the back-up roll 14, to allow clearance of strip splices therebetween. The head support or deck 34, shaft 38 and associated frame structure 40 are described in greater detail in U.S. Pat. No. 4,675,230.

In accordance with the invention, and as a particular feature thereof, the apparatus further includes means acting between the head support deck 34 and the head 20 for continuously exerting a load on the head to urge the head toward the facing major surface 12 of the strip 10, so as to overcome hydrodynamic forces generated when the coating is forced through the wedge-shaped gap between the strip major surface and the head ceramic face 24.

The load exerting means, in the illustrated embodiment of the apparatus, is a plurality of air cylinders 42 which are secured to the head support deck 34 rearwardly of the head 20. The air cylinders may be of any known construction and may include cylinders which operate pneumatically or hydraulically or which use some combination of air and hydraulic fluid. Each air cylinder 42 includes a piston having a shaft 43 which extends forwardly from the cylinder through the head support deck 34 to bear against the rear surface of the head 20. Attachment of the apparatus air cylinders 42 to the apparatus and operation of the cylinders is described in greater detail in U.S. Pat. No. 4,675,230.

Any number of air cylinders may be utilized to operate the present invention, but the use of at least 2 air cylinders is recommended. By way of example, 4 air cylinders are shown in FIG. 1. The exact number of air cylinders that are used on the coating device also depends upon the width of the metal strip 10 to be coated. For example, a 29 inch-wide coating device might have 5 air cylinders across its width and a 48 inch-wide coater assembly could use 7 air cylinders. There are no hard and fast rules for determining the number of load-exerting means to be used for any given width of coater assembly. The number of air cylinders utilized to operate the present invention is dependent upon coating viscosity, line speed, area of the coating head ceramic face, the slope of the face with respect to the substrate and the profile of the strip, which all affect the magnitude of hydrodynamic force generated by the coater.

As previously discussed, the wedge-shaped air gap between the moving article major surface 12 and the ceramic surface 24 strip-pumps the coating through the gap as it passes the emitting slot 26. This action creates a hydrodynamic force that works against the area of the ceramic face 24 to push it away from the strip. The hydrodynamic force is opposed by the air cylinders. The magnitude of the hydrodynamic force can be readily calculated and an appropriate number of air cylinders can similarly be readily calculated by matching the specifications for a commercially available air cylinder to the calculated requirements, such as safe working load per cylinder.

A designer must also take into account the structural dimensions of the coating head and the desired location of the air cylinders and determine what degree of coating head flexure will be permissible in order to maintain desired coating thickness tolerances. The coating head must have sufficient flexibility to allow for localized flexure of the coating head, so that the head can conform to localized changes in surfaced topography of the coating strip 10, yet must not allow uncontrolled bowing between air cylinders, which will adversely affect control of the coating thickness.

Each air cylinder preferably has a separate means for varying the load to be exerted by the cylinder. Thus, each air cylinder should have some form of valve which responds to a control signal for intaking or exhausting pressurized air or other pressurized fluid to or from the cylinder, so as to increase or decrease pressure on the cylinder piston. As shown in FIG. 2, the air cylinder 42 preferably has an air cylinder intake valve 44 which is connected to the cylinder by air feed line 45 and to a pressurized air supply 46. The apparatus also has an air cylinder exhaust valve 48 which is connected to an air exhaust line 50. The cylinder air supply preferably includes a pressure transducer 52 that can be monitored to determine air pressure within the cylinder 42 and feed line 45. As shown in FIG. 2, the air pressure intake and exhaust valves and the pressure transducer 52 are all connected to the cylinder 42 by way of the air feed line 45.

A desirable way to control air pressure within the air cylinder 42 is to configure the air pressure control valves to intake or exhaust a fixed pressure change in response to a single control signal. For example, either one of the air pressure control valves can be set to cause a one-half pound-per-square-inch (0.5 PSI) pressure increase or drop in response to receipt of a control signal.

The coating device 16 of the present invention has means for sensing distance between the extended surface 22 of the head 20 and the article major surface 12 in a direction transverse to the long dimension of the slot 26 and for generating a sensor signal indicative of such distance. As shown in FIG. 3, the sensing means is a sensor 54 which is mounted in a recess in the head 20 behind one of the ceramic plates 24. The preferred sensor 54 is an inductive electromagnetic transducer, such as one manufactured by Electro Corporation of Sarasota, Fla. and designated as model 27132. Such an inductive electromagnetic transducer is paired with a transducer controller 56, such as the Electro Corporation model PBA 200. The sensing means, such as the inductive electromagnetic transducer and transducer controller generate a sensor signal which, once calibrated, is indicative of the distance or gap between the head extended surface 22 and the strip major surface 12.

As shown in FIG. 3, the sensor 54 is mounted in a recess in the head 20 directly in line with the air cylinder shaft 43. The coating apparatus 16 has a plurality of sensors, and has at least one sensor dedicated to each air cylinder. If desired, more than one sensor can be dedicated to each air cylinder, so that sensor readings can be arithmetically averaged and in the case of error signal detection, such as when sensor failure is detected, the erroneous sensor reading can be discarded. Any sensor arithmetic averaging or error analysis technique known in the art may be used.

Sensor signals from a given sensor 54 are transmitted by a sensor line 58 to an interface 60. The air cylinder intake valve 44 and exhaust valve 48 and pressure transducer 52 are also electrically connected to the interface 60. The interface may be of any known design which is capable of receiving and transmitting signal inputs and outputs to electromechanical devices and which is capable of transmitting the electromechanical input/output signals to a means for controlling the signals, such as a computer. As shown in FIG. 2, a computer 62 of any known construction is connected to the interface 60 and is capable of communicating with the sensors 54 pressure transducers 52 and the air cylinder intake and exhaust valves 44 and 48. In operation, one or more sensors that are dedicated to a specific air cylinder and air cylinder pressure control valves are interconnected through the interface to a computer as a "family" of components that sense distance between the head extended surface 22 and the strip major surface 12 and are capable of varying the load which is exerted by the air cylinder.

Each family of air cylinder pressure control valves, pressure transducers and sensors may be connected to separate computers, or a plurality of such families may be connected to a single computer. Up to five separate families of sensors and air pressure controls may be connected to a single IBM compatible personal computer which employs Intel Model 80386 microprocessor architecture, such as a Compaq brand Model 386 personal computer. If a single family of sensor and air cylinder pressure controls is connected to a single computer dedicated to that family, then an IBM compatible personal computer based on the Intel Model 80286 microprocessor has sufficient processing speed to run the control system. It is also contemplated that any general purpose computer or custom-designed microprocessor can be used as the control means to monitor and operate the control system of the present invention.

Figure 4A:
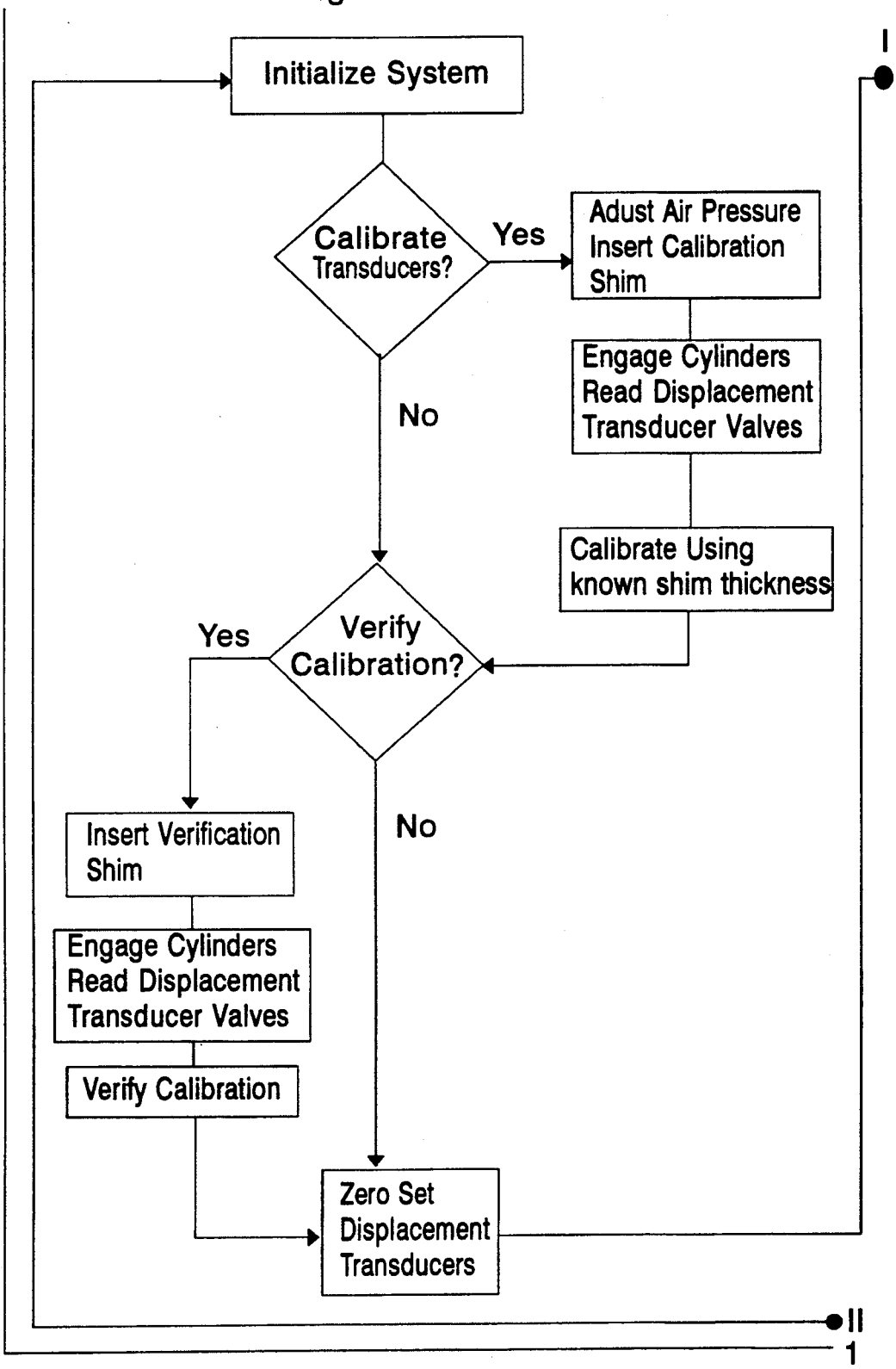
FIGS. 4A and 4B, and 4C are a process flow chart showing operation of the control system of the present invention, wherein the figure sheets are joined at their reference points I and II.
Figure 4B:
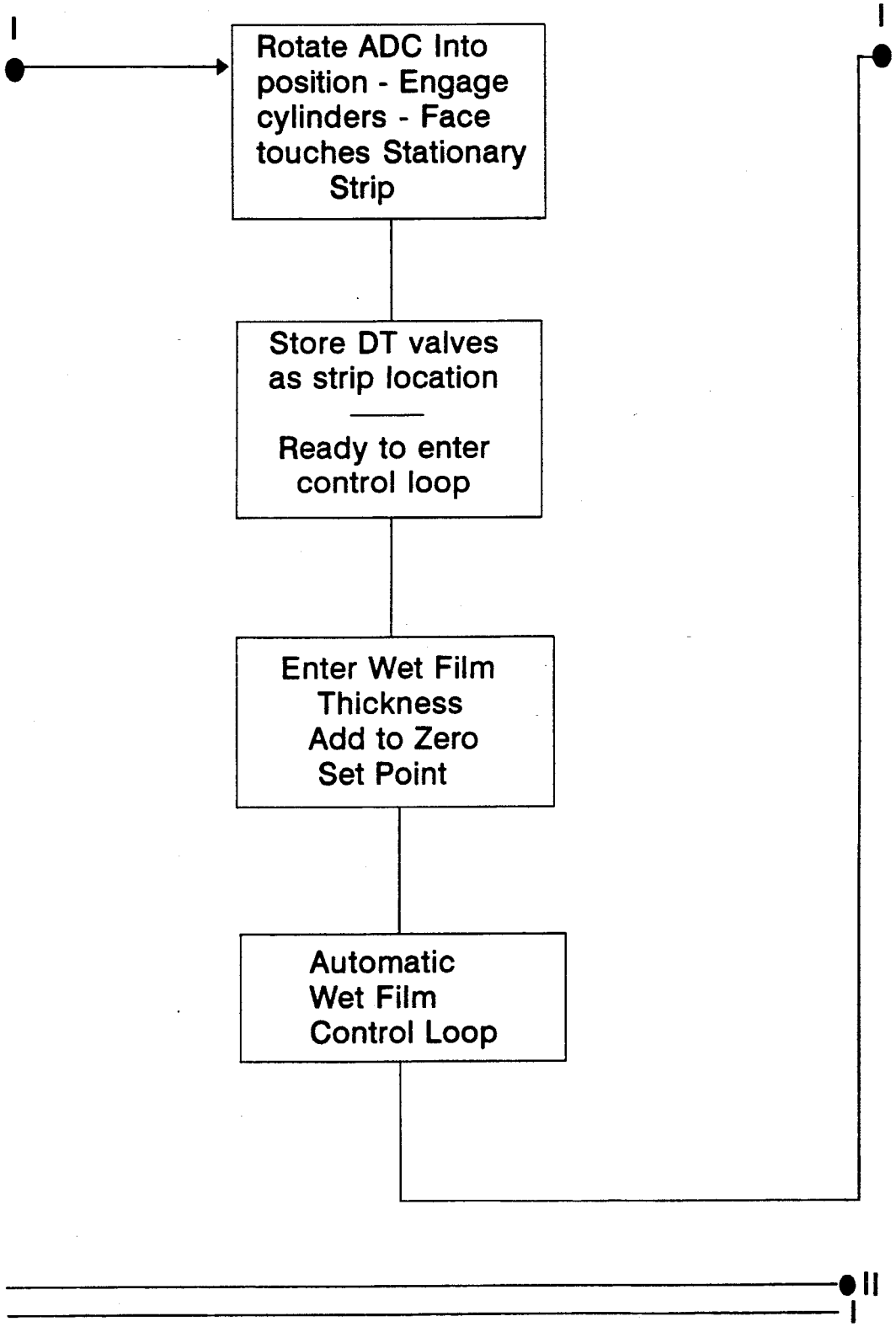
Figure 4C:
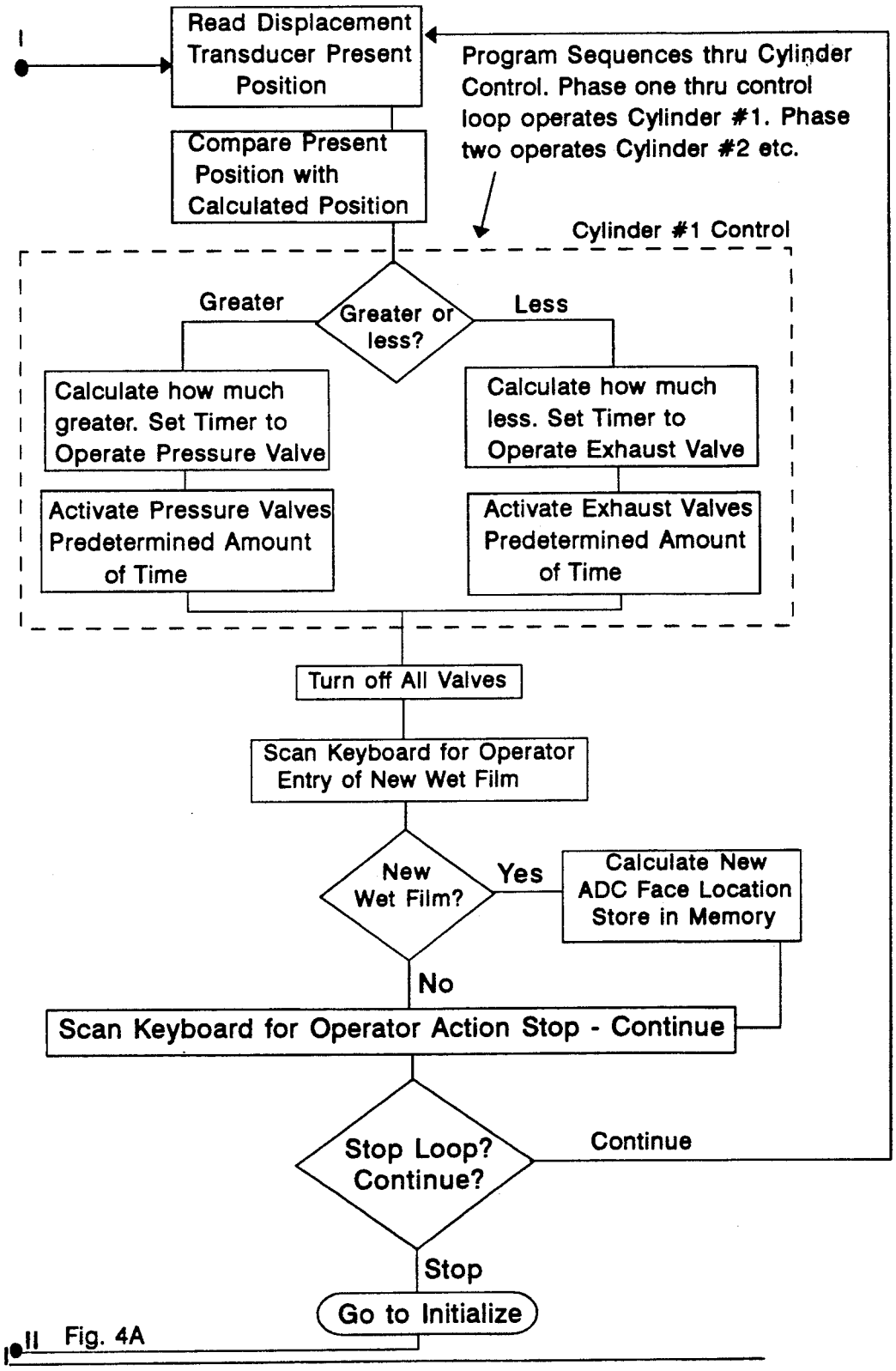

The operation of the described apparatus and the performance of the method of the invention therewith may now be readily explained with reference to FIGS. 4A–4C. General operation of the strip advancing roll and the hydrodynamic aspects of applying coating material from the head slot 26 to the strip major surface 12 is fully described in U.S. Pat. No. 4,675,230 and is not repeated herein. Detailed disclosure concerning operation of the control system aspects of the present invention are as follows.

Before utilization of the coating device 16 of the present invention, the system is initialized by determining the transducer signal output reading that is generated when the head extended surface 22 is in contact with the article major surface 12, which article is supported by the back-up roll 14. This initialized reading for each sensor is obtained by exerting a load pressure on the head 20 with each air cylinder 42, so as to urge the head against the strip major surface 12 as supported by the back-up roll 14 along the entire width of the head. The initialized sensor reading is stored by the computer 62. Individual sensor calibration is performed by inserting calibration shims between the head extended surface 22 and the electromagnetically conductive strip major surface 12 on the roll 14 and storing the transducer reading for each shim thickness. Calibration may be verified with shims whenever desired by the operator.

Based on calibration information for each individual sensor 54, that is stored in the computer 62, incremental change in the sensor output signal corresponds to a change in distance between the transducer and an electromagnetically conductive surface. Inasmuch as the sensor 54 is mounted behind an electromagnetically nonconducting ceramic plate 24, the head 20 does not affect the transducer reading. When an electromagnetically conductive strip 10 is interposed between the take-up roll 14 and the head 20, the sensor 54 will take readings off the strip major face 12, rather than off the roll.

When the article major surface 12 is interposed between the takeup roll 14 and the head extended surface 22, the sensor reading is now indicative of the distance between the article major surface 12 and the head extended surface 22. The sensor 54 reading is transmitted to the computer 62 via the relay 60.

The apparatus operator enters into the computer the With respect to each sensor, the computer calculates the sensor output signal reading which corresponds to the desired coating thickness (i.e., the desired distance between the strip major surface and the head extended surface). During each automatic wet film control loop operational cycle, the computer compares the desired sensor output reading with the actual sensor output reading. If the actual sensor 54 reading is higher than the desired reading (i.e., the inductance is too low), then the head extended surface 22 is too far away from the strip major surface 12. More load must be exerted by the air cylinder, in order to overcome the hydrodynamic force generated by the coating wet film on the head 20 and urge the head closer to the strip surface 12. Conversely, a lower than desired sensor 54 output signal indicates that the head 20 is too close to the strip surface 12, thereby necessitating decreasing the load exerted by the cylinder 42 on the head 20. Based on the difference between the actual sensor signal reading and the desired reading, the computer will vary the load exerted on the head by the air cylinder 42 associated with the specific sensor by generating and transmitting control signals to the air cylinder intake 44 or exhaust valve 48 associated with that cylinder, so as to change the air pressure within and the resultant load generated by the cylinder. A decrease in air pressure in cylinder 42 decreases load exerted by the cylinder, which in turn causes the head 20 to separate from the strip surface 17. Conversely, increasing the air cylinder 42 pressure increases the cylinder load, which in turn decreases the distance between the head extended surface 22 and the article major surface 12.

In operation, it is desirable to have relatively frequent sampling of the sensor and effect small, rapid changes in air pressure, rather than to take relatively more infrequent readings of the sensor and effect relatively larger changes in cylinder air pressure. Most desirably, one institutes a high sampling and control system action rate by taking sensor readings frequently and adjusting the air cylinder pressure in small definitized quanta of air pressure increases or decreases (e.g. 0.5 PSI per operational cycle), which allows the control system to accommodate changes in surface topography of the article major surface 12 as it is transported past the coating head 20 by the back-up roll 14. For example, if cylinder pressure adjustments are effected in 0.5 PSI increments and a cylinder requires a 2 PSI pressure increase, the cylinder pressure will be raised 2 PSI over four operational cycles.

If more than one family of sensors, cylinders and control valves shares a computer, then the computer can sequence through each family in a multiplexed, round-robin fashion. For example, if there are three families, cylinder 1 is mounted and controlled in operational cycle 1, cylinder 2 in operational cycle 2, cylinder 3 in cycle 3 and back to cylinder 1 in cycle 4. The automatic film thickness control loop may be stopped by operator command through the computer keyboard or my a timer. For example, if the strip is advancing at 8 feet per second and 4,000 feet of strip must be coated, the coater can be preset to run for. 500 seconds. If desired, the operator can also vary the film thickness to be regulated by the apparatus through a computer input command.

It is to be understood that the invention is not limited to the features and embodiments hereinabove specifically set forth, but may be carried out in other ways without departure from its spirit.

What is claimed is:

1. An apparatus for coating a major surface of a continuously longitudinally advancing elongated strip article with a uniform predetermined thickness of a liquid coating material comprising:

(a) means for continuously longitudinally advancing the strip article over a support for the strip article;

(b) means for positioning an extended surface a predetermined distance away from the major surface of the strip article opposite the strip support, which major surface extends in the direction of advancement of the strip article and traverses a path defined by the advancing article, while said means for positioning permits translational movement of the extended surface perpendicular to the strip article major surface, forming a distance gap having a height between the major surface and the extended surface, which gap height varies in response to the translational movement;

(c) means for supplying liquid coating material to the gap sufficient to fill the gap substantially as the strip article advances past the extended surface;

(d) means for continuously urging the extended surface toward the major surface by exerting on the extended surface a load having a variable magnitude;

(e) means mounted behind and adjacent to extended surface, for repetitively sensing the gap distance between the extended surface and the adjacent article major surface and for generating a sensor signal; and (f) means for controlling the urging means to vary the load magnitude on the extended surface in response to the sensor signal, so as to reduce difference between the gap height and a predetermined height, thus producing a layer of liquid coating material of a predetermined film thickness on the longitudinally advancing strip article.

2. The apparatus of claim 1, wherein the urging means is an air cylinder.

3. The apparatus of claim 1, wherein:

(a) the urging means is plurality of air cylinders acting on the extended surface at spaced locations along a length thereof that is transverse to the direction of strip advancement; and the sensing means is a plurality of sensors mounted in the extended surface in proximity to each air cylinder with each sensor generating a separate sensor signal.

4. The apparatus of claim 1, wherein the control means is a computer coupled to the sensing means for receiving the sensor signal and coupled to the urging means for transmitting a control signal to the urging means indicative of the load magnitude to be exerted thereby, the computer generating the control signal in response to the sensor signal.

5. The apparatus of claim 1, wherein:

(a) the urging means is a plurality of air cylinders acting on the extended surface at spaced locations along a length thereof that is transverse to the direction of strip advancement;

(b) the sensing means is a plurality of sensors mounted in the extended surface in proximity to each air cylinder, with each sensor generating a separate sensor signal dedicated to the air cylinder in closest proximity thereto; and the control means is at least one computer coupled to each sensor for receiving the sensor signals and coupled to the air cylinders for transmitting a separate control signal to each air cylinder indicative of the load magnitude to be exerted thereby, the computer generating each control signal in response to a sensor signal of a sensor associated with the air cylinder.

6. The apparatus of claim 5, wherein a separate computer is coupled to each pair of separately associated sensor and air cylinder.

7. The apparatus of claim 1, wherein the sensing means includes an inductive electromagnetic transducer that is mounted in a recess constructed in the extended surface.

8. The apparatus of claim 1, wherein the advancing means includes a roll having an axis parallel to a long dimension of the extended surface, the roll further having a cylinder surface positioned adjacent to the extended surface; and wherein the extended surface is shaped and positioned to approach progressively nearer to the cylindrical surface in the direction of advance of the article.

9. An apparatus for coating a major surface of an elongated strip article, comprising:

(a) a coating head defining an elongated, opensided slot and having an extended surface immediately adjacent the open side of the slot;

(b) means for supplying liquid coating material under pressure to the slot;

(c) means for continuously longitudinally advancing a strip article successively past the slot open side and the extended surface of the head in a direction transverse to the long dimension of the slot while maintaining a major surface of the article in facing proximate relation to the slot so as to constitute a moving wall substantially closing the open side, such that during operation with the article advancing past the slot and liquid coating material supplied to the slot, the last-mentioned article major surface drags a layer of the coating material from the slot, the advancing means supporting the strip opposite the slot, at a fixed distance from the head supporting means;

(d) means for supporting the head while permitting movement of the head toward or away form said means for continuously longitudinally advancing a strip article;

(e) a plurality of variable-pressure air cylinders between the head-supporting means and the head at spaced locations along the length of the slot, for continuously exerting a load on the head to urge the head toward the last-mentioned article major surface such that, during operation as aforesaid, the head is pressed by the cylinders against the deposited layer of coating material to maintain the layer at a predetermined constant thickness while the layer alone holds the head entirely away from contact with the last-mentioned article major surface;

(f) at least one valve coupled to each air cylinder and an air pressure source for regulating cylinder air pressure in response to a control signal which is indicative of air pressure to be applied to the cylinder;

(g) a plurality of inductive electromagnetic transducer sensors which are mounted in recesses constructed in the extended surface of the head, for sensing distance between the extended surface of the head and article major surface in a direction transverse to the long dimension of the slot, each sensor being located proximal to and associated with an air cylinder, and for generating a sensor signal indicative of such distance; and (h) at least one computer coupled to the sensors and the air valves for receiving sensor signals, generating a control signal in response to the sensor signal, and routing the control signal to the valve of the air cylinder associated with the sensor.

10. An apparatus for controlling film thickness of a liquid coating material that is applied to a major surface of a continuously advancing article comprising:

(a) means for positioning an extended surface a predetermined distance away from the major surface, which major surface is extended in a direction of article advancement along an advancement path, so that the extended surface traverses the path and is translatable in a direction perpendicular to the article major surface, with the extended surface and the major surface forming a distance gap therebetween which is variable in response to extended surface translation;

(b) means for continuously advancing the article successively past the extended surface;

(c) means for supplying liquid coating material to the gap in sufficient quantities to fill the gap substantially as the article advances past the extended surface;

(d) means mounted behind and adjacent to the extended surface, for sensing repetitively distance between the extended surface and the article major surface and for generating a sensor signal indicative of such sensed distance;

(e) means for continuously urging the extended surface toward the major surface by exerting on the extended surface a load having a variable magnitude; and (f) means for varying the load in response to the sensor signals so as to reduce difference between the sensed distance and a predetermined distance, thus producing a layer of liquid coating material having a predetermined film thickness on the article.

* * * * *